US011331532B2

(12) United States Patent
Hunt et al.

(10) Patent No.: US 11,331,532 B2
(45) Date of Patent: May 17, 2022

(54) SPHERICAL DYNAMIC RESISTANCE DEVICE

(71) Applicant: The Wild Gym Company LLC, Niwot, CO (US)

(72) Inventors: David Hunt, Coram, MT (US); Daniel Vinson, Lafayette, CO (US)

(73) Assignee: THE WILD GYM COMPANY LLC, Louisville, CO (US)

( * ) Notice: Subject to any disclaimer, the term of this patent is extended or adjusted under 35 U.S.C. 154(b) by 62 days.

(21) Appl. No.: 16/925,087

(22) Filed: Jul. 9, 2020

(65) Prior Publication Data

US 2021/0016131 A1 Jan. 21, 2021

Related U.S. Application Data

(60) Provisional application No. 62/875,835, filed on Jul. 18, 2019.

(51) Int. Cl.

| | |
|---|---|
| ***A63B 21/00*** | (2006.01) |
| ***A63B 21/055*** | (2006.01) |
| ***A63B 21/16*** | (2006.01) |
| ***A63B 43/00*** | (2006.01) |
| ***A63B 23/16*** | (2006.01) |

(Continued)

(52) U.S. Cl.

CPC ..... *A63B 21/4035* (2015.10); *A63B 21/0557* (2013.01); *A63B 21/0604* (2013.01); *A63B 21/1618* (2013.01); *A63B 23/16* (2013.01); *A63B 43/007* (2013.01); *A63B 71/0036* (2013.01)

(58) Field of Classification Search

CPC ..... A63B 21/4035; A63B 21/0557; A63B 21/0604; A63B 21/1618; A63B 23/16; A63B 43/007; A63B 71/0036; A63B 21/0442; A63B 21/072; A63B 23/03525; A63B 65/06; A63B 21/1663; A63B 21/06–227; A63B 65/12–127; A63H 5/00

See application file for complete search history.

(56) References Cited

U.S. PATENT DOCUMENTS 3,220,729 A * 11/1965 Whittington ..... A63B 43/007 473/575

3,410,554 A * 11/1968 Harrison ..... A63B 21/00192 273/453

(Continued)

*Primary Examiner* — Nyca T Nguyen

(74) *Attorney, Agent, or Firm* — Martensen IP; Michael C. Martensen

(57) ABSTRACT

The spherical dynamic resistance device enables simultaneous strength, core and cardiovascular training. A cavity exists whereby resistance bands are stored. By removing a band and connecting it to the exterior of the device at an attachment point and thereafter attaching the other end of the resistance band to a fixed point a user can engaged device to conduct a full body workout. The cavity can also retain a mass element adding weight thereby customizing the weight of the spherical dynamic resistance device. A serpentine channel associated with the outer portion of the device enables a user to grip the device while engaging hand, arm and core muscles. By gripping the device and through various motions that pull opposite of the resistance band while supporting the spherical dynamic resistance device of various weights, a user is able to attain a full body workout.

19 Claims, 13 Drawing Sheets

(51) Int. Cl.
*A63B 21/06* (2006.01)
*A63B 71/00* (2006.01)

(56) References Cited

U.S. PATENT DOCUMENTS 4,121,829 A * 10/1978 Petrusek ..... A63B 69/0086 473/576
D309,484 S * 7/1990 Arad ..... D21/672
5,236,411 A * 8/1993 Backman ..... A61F 5/3753 128/845
5,242,348 A * 9/1993 Bates ..... A63B 21/0004 482/105
5,282,777 A * 2/1994 Myers ..... A63B 21/0004 473/576
5,588,648 A * 12/1996 Stebbins ..... A63B 37/02 473/451
5,611,540 A * 3/1997 Williams ..... A63B 43/007 473/429
5,857,946 A * 1/1999 Brown ..... A63B 21/072 482/108
5,961,406 A * 10/1999 Hass ..... A01K 15/025 119/707
6,354,970 B1 * 3/2002 Reinke ..... A63B 37/00 473/600
D455,182 S * 4/2002 Chu ..... D21/398
6,478,699 B1 * 11/2002 Fairweather ..... A63B 69/0079 273/317.8
7,137,914 B1 * 11/2006 Boyer ..... A63B 43/007 473/575
7,141,012 B2 * 11/2006 Lin ..... A63B 21/0004 482/126
7,326,123 B2 * 2/2008 Park ..... A63B 21/0608 473/212
D594,703 S * 6/2009 Sax ..... D7/515
D673,740 S * 1/2013 Burger ..... D30/160
8,683,958 B2 * 4/2014 Oblack ..... A63B 37/12 119/707
D705,876 S * 5/2014 Oblack ..... D21/712
8,911,334 B1 * 12/2014 Cotter ..... A63B 21/0602 482/111
9,333,105 B2 * 5/2016 Lane ..... A61F 5/0118
9,616,272 B1 * 4/2017 Bennett ..... A63B 21/0602
D789,461 S * 6/2017 Magloire ..... D21/682
D798,969 S * 10/2017 Lozito ..... D21/682
9,789,376 B1 * 10/2017 Henry ..... A63B 69/205
D838,417 S * 1/2019 Jiang ..... D30/160
D840,116 S * 2/2019 Steinkraus ..... D30/160
10,300,329 B2 * 5/2019 Byrd ..... A63B 21/0607
D886,397 S * 6/2020 Baker ..... D30/160
10,765,904 B1 * 9/2020 Pasterino ..... A63B 21/0557
10,765,905 B2 * 9/2020 Wang ..... A63B 43/005
D904,700 S * 12/2020 Baker ..... D30/160
D911,462 S * 2/2021 Blum ..... D21/680
2001/0001094 A1 * 5/2001 Panes ..... A63B 43/02 482/93
2003/0224914 A1 * 12/2003 De Montesquieux . A63B 41/00 482/148
2004/0038784 A1 * 2/2004 Huang ..... A63B 43/007 482/121
2004/0204299 A1 * 10/2004 Shirley ..... A63B 43/007 482/81
2005/0143234 A1 * 6/2005 Massey ..... A63B 21/04 482/140
2006/0264300 A1 * 11/2006 Chen ..... A63B 69/0079 482/14
2007/0179021 A1 * 8/2007 Wang ..... A63B 65/06 482/49
2008/0072886 A1 * 3/2008 Cattlin ..... A01K 15/025 124/5
2008/0139349 A1 * 6/2008 Ou ..... A63B 41/10 473/604
2010/0203987 A1 * 8/2010 Bagley ..... A01K 15/025 473/571
2011/0263393 A1 * 10/2011 Ross ..... A63B 21/0724 482/93
2012/0065027 A1 * 3/2012 Zachary ..... A63B 21/055 482/48
2012/0178597 A1 * 7/2012 Januszek ..... A63B 21/0724 482/108
2012/0184418 A1 * 7/2012 Wilson ..... A63B 21/00043 482/112
2012/0225740 A1 * 9/2012 Gibadlo ..... A63B 69/0071 473/423
2013/0085045 A1 * 4/2013 Chavez ..... A63B 21/0552 482/93
2013/0337980 A1 * 12/2013 Himmelrick ..... A63B 21/072 482/108
2014/0274611 A1 * 9/2014 Rex ..... A63B 43/02 482/139
2014/0336021 A1 * 11/2014 Jones ..... A63B 21/0004 482/132
2015/0182777 A1 * 7/2015 Rarity, IV ..... A63B 21/075 482/93
2015/0343257 A1 * 12/2015 Cooper ..... A63B 21/0722 482/93
2016/0107017 A1 * 4/2016 Pawlas ..... A63B 21/0004 482/93
2016/0151693 A1 * 6/2016 Keith ..... A63B 43/02 473/424
2016/0256730 A1 * 9/2016 Bartos ..... A63B 21/072
2016/0375317 A1 * 12/2016 Connelly ..... A63B 37/02 473/606
2017/0095718 A1 * 4/2017 Li ..... A63B 69/0079
2018/0056141 A1 * 3/2018 Fant ..... A63B 69/345

* cited by examiner

SPHERICAL DYNAMIC RESISTANCE DEVICE

RELATED APPLICATION

The present application relates to and claims the benefit of priority to U.S. Provisional Patent Application No. 62/875,835 filed 18 Jul. 2019 which is hereby incorporated by reference in its entirety for all purposes as if fully set forth herein.

BACKGROUND OF THE INVENTION

Field of the Invention

Embodiments of the present invention relate, in general, to physical resistance training and more particularly to a spherical dynamic resistance device.

Relevant Background

Fitness balls are used in a wide variety of exercise programs including strength training, cardiovascular training, and physical therapy. Conventionally, fitness balls (also known as medicine balls) are constructed of a material or filler wrapped in a leather, rubber, or plastic cover or shell. In some versions of fitness balls, the filler provides a cushioning effect so that the ball is suitable for exercises which involve impacts against a user's body, the floor, wall or other fitness equipment. The filler may also be weighted depending on the nature of the activity the medicine ball is to be used for and in many instances a facility may possess several balls each of a different weight. Weight of a fitness ball is generally a function of the filler material used and the size of the ball. Likewise, fitness balls are produced in a variety of sizes to accommodate different users and exercise routines.

Some fitness/medicine balls include external handles to facilitate additional functionality or to reduce user fatigue caused from grasping the spherical outer surface of the medicine ball. Some balls have external handles on diametrically opposed sides of the ball while others fashion the ball to create an internal handle. Many professional, student, and occasional athletes as well as the general public have found the use of fitness balls to be an excellent addition to their workout routine. Using fitness balls can help develop abdominal and core strength. By lifting or holding the ball while performing other exercises such as leg lifts, sit-ups etc. the effect of the underling exercise is amplified.

In most instances, fitness balls represent an independent fitness apparatus. They are not linked, attached or part of a larger fitness system. As a results fitness balls offer a limited scope of exercise training. Other fitness equipment, such as dumbbells, kettlebells, barbells, exercise machines, punching bags, and/or any number of other equipment are needed to broaden the range of exercises that a user can perform. Especially for users who train at home, purchasing and storing an abundance of different fitness equipment is often both cost and space prohibitive. As such, fitness equipment which can be used for a broad range of different exercises is desirable.

Exercise devices which allow for seamless transitions between individual exercises are also highly desirable, particularly in circuit training or high intensity interval training routines. For example, a user may wish to perform a strength-training exercise such as a biceps curl, then, immediately and without changing equipment, perform another exercise such as a core twist. A need exists for multifunctional fitness equipment that allows a user to engage in several types of exercises in rapid sequence and yet be suitable for a home exercise environment. These and other deficiencies of the prior art are addressed by one or more embodiments of the present invention.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

The spherical dynamic resistance device of the present invention activates muscles. The portability of the present invention allows the user to store resistance bands inside when not in use while incorporating a modular weighted core that can be inserted into the device to make a workout harder. A channel that meanders across the exterior surface of the device enables a user to engage hand, wrist, arm, shoulder and core muscles simultaneously making any workout with the device more effective and more efficient. Lastly, the device is ideal for home use as no other device offers multiple connection loops for the resistance band to connect to and can easily be affixed to an internal structure to form the centroid of a resistance workout.

One embodiment of the present invention includes a spherical casing having an inner portion and an outer portion wherein the outer portion includes an outer surface. Within the outer surface is a serpentine continuous channel that extends inward toward the inner portion. The channel has a depth, a first width associated with the outer surface or top of the channel and a second width associated with a bottom channel surface. In one embodiment the second width is less than the first width.

The invention also includes a void region or cavity encompassed by an inner surface of the spherical casing. The cavity is accessed via a circular access port which covered by a circular plug that is removably attached to the outer portion of the spherical casing. Lastly the device includes a plurality of attachment loops secured to the outer portion.

Another aspect of the invention is the inclusion of one or more resistance bands that can be removably coupled to one of the attachment loops. The resistance bands can further include a door anchor or the like by which one end of the resistance band can be affixed to a stationary structure or object. When not in use the resistant bands are storable within the void region.

The present invention, in another embodiment, can include mass element insertable into the void region through the circular access port and attachable to the spherical casing or the lid. The element can be cylindrical and affixed/attachable to the device or can be of an amorphous and allowed to move about within the cavity.

The serpentine continuous channel of the present invention includes opposing walls extending from the outer surface to, and terminating at, the bottom channel surface. In one embodiment of the present invention each of the opposing wall has a concave shape making the channel convex. The convex shape is configured to engage contralateral irradiation muscle activity of a user. In addition, the channel meanders about the outer surface of the casing forming a "U" shape on opposite hemispheres of the outer portion while being substantially parallel on a single, other, hemisphere of the outer portion.

The spherical dynamic resistance device of the present invention is pliable and, in one embodiment formed using is injection molded foam, although, other material consistent with this disclosure are suitable and indeed contemplated.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1A:
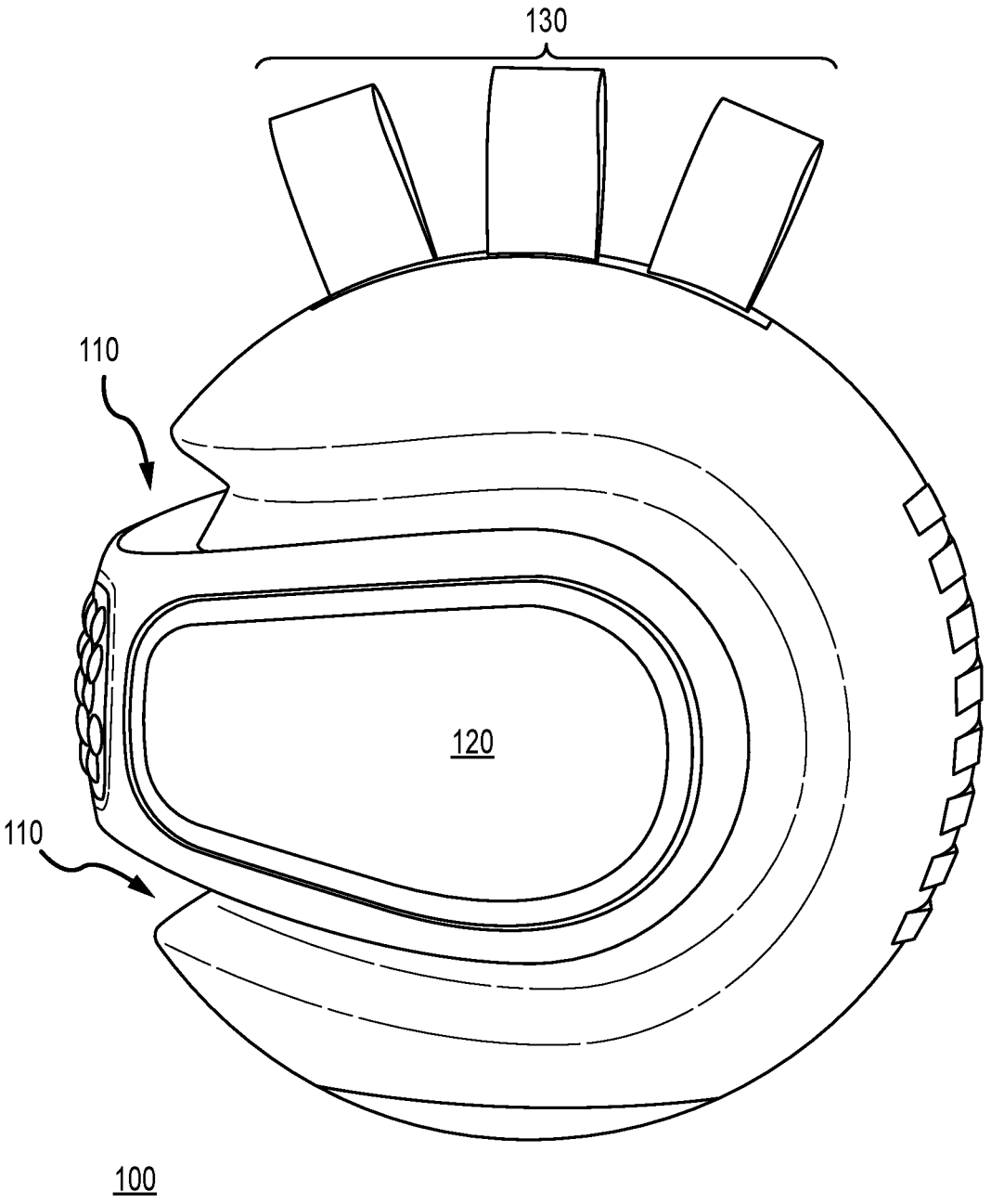
FIGS. 1A and 1B provide perspective view of one embodiment of the spherical dynamic resistance device.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

The spherical dynamic resistance device of the present invention enables strength, core and cardiovascular training simultaneously as a self-contained device usable in a home or fitness facility environment. One aspect of the invention is a bottom "plug", by which a user can access the interior of the device. Within the interior of the device, also referred to herein as the void region or cavity, resides one or more resistance bands of a variety of strength (resistance). By removing a band and connecting it to the exterior of the device at an attachment point and attaching the other end of the resistance band to a fixed point (door, wall-mount, beam, tree, etc.) the user is ready to use the device in workout mode. In other embodiments the empty space inside the ball can retain a "Mass Core" or mass element adding weight to the device. A user can possess a plurality of Mass Core additions thereby customizing the weight of the spherical dynamic resistance device. By gripping the device and through twisting, torqueing, jumping, pivoting, lunging, squatting, raising, spinning, extending, and other various motions that pull opposite of the resistance band and while supporting the spherical dynamic resistance device of various weights, a user is able to attain a full body workout.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Figure 1B:
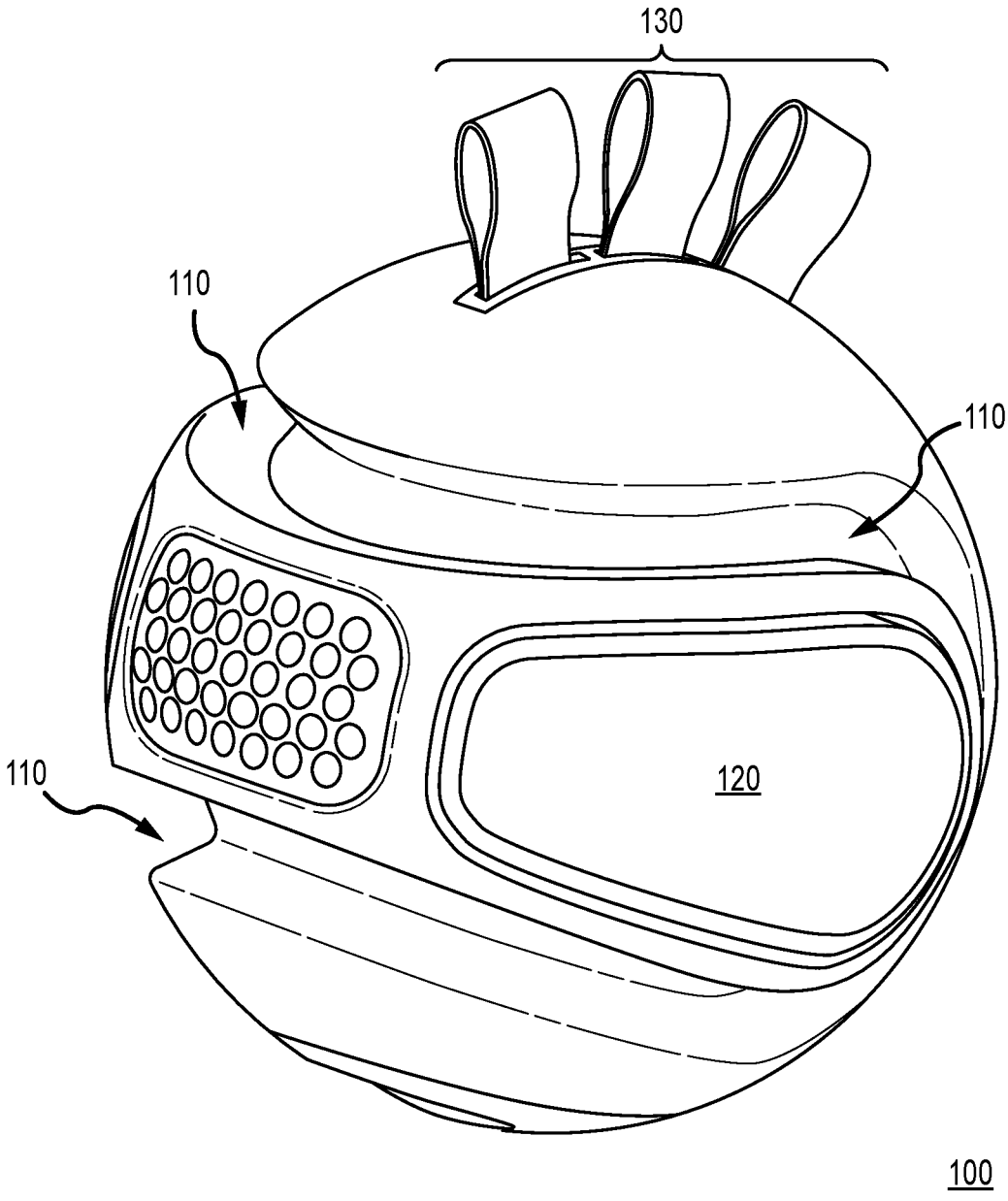

One embodiment of the present invention, as shown in FIGS. 1A and 1B, comprise a substantially spherical device for use as a resistance fitness tool. The device 100 includes special grips and/or channels that utilize irradiation to activate your muscles. For the purpose of this application, irradiation is a spread of muscle activation that "augments postural stability and enables the transfer of power across joints by two-joint muscles. Unlike normal grips which are a handle, the grips of the present invention are specifically designed to activate muscles in your core, arms, and chest (before you even begin your workout). By using a wide, flat curvilinear surface, the open position of the hands activates more muscles having a synergistic effect during a workout. The device of the present invention includes multiple grip options, including single hand/arm grips as well as the ability to engage the device with fingertips thereby adding even more muscle interaction.

Enclosed within an interior cavity of the sphere are one or more resistance bands to create resistance. A resistance band is an elastic cord or band which provides various degrees of resistance as the band/cord is stretched. In one embodiment of the present invention a resistance band can be temporally attached to a fixed structure, (door, post, tree, etc.) and connected to the resistance device of the present invention using the provided loops/attachment points. By griping the ball and imposing a force against the bands through the bands the user gains a workout from both the band resistance and simply holding the ball. The resistance band further creates a rotational force that pulls your body back to a center point adding to the overall effectiveness of the device.

In another embodiment, an optional core element can be added to the device to increase the device's overall weight. The element can include various increments of weight so that the overall weight of the ball can be modified based on the fitness level of the user and the degree of desired resistance.

FIGS. 1A and 1B present perspective views spherical dynamic resistance device of the present invention. The device 100 is substantially spherical in shape with a serpentine channel 110 integrated into the outer surface. The channel is continuous but does not circumscribe the sphere. The design of the channel provides two flat hand holds 120 on opposite sides of sphere by which a user can grip the sphere with their fingers and/or the flat portions of the inner hand. The sphere also includes one or more attachment points 130 by which a resistance can be removably attached.

The version of the present invention shown in FIGS. 1A and 1B provide three attachment points 130 for a resistance band. The location of the attachment points 130 differs in relation to the location of the channel 110, thereby producing different muscle interactions as the device is pulled away from a wall mount on which the resistance band is attached. In the version shown in FIGS. 1A and 1B the attachment points are loops formed from planar straps or similar material. The loops are aligned so that the resistance band can attached to any one of the attachment points or any combination thereof. In other configurations more or fewer loops can be added and the loops may be offset and have various angular configurations. In the rendition shown in FIG. 1B the loops form a line substantially equal distant from the channel.

The angle by which the resistance band imparts a force to the spherical dynamic resistant tool of the present invention varies based on which attachment point is utilized. As will be appreciated by one of reasonable skill in the relevant art, the selection of the resistance bands, attachment points and weight of the device activate different muscle groups increasing the versatility of the present invention.

Figure 2:
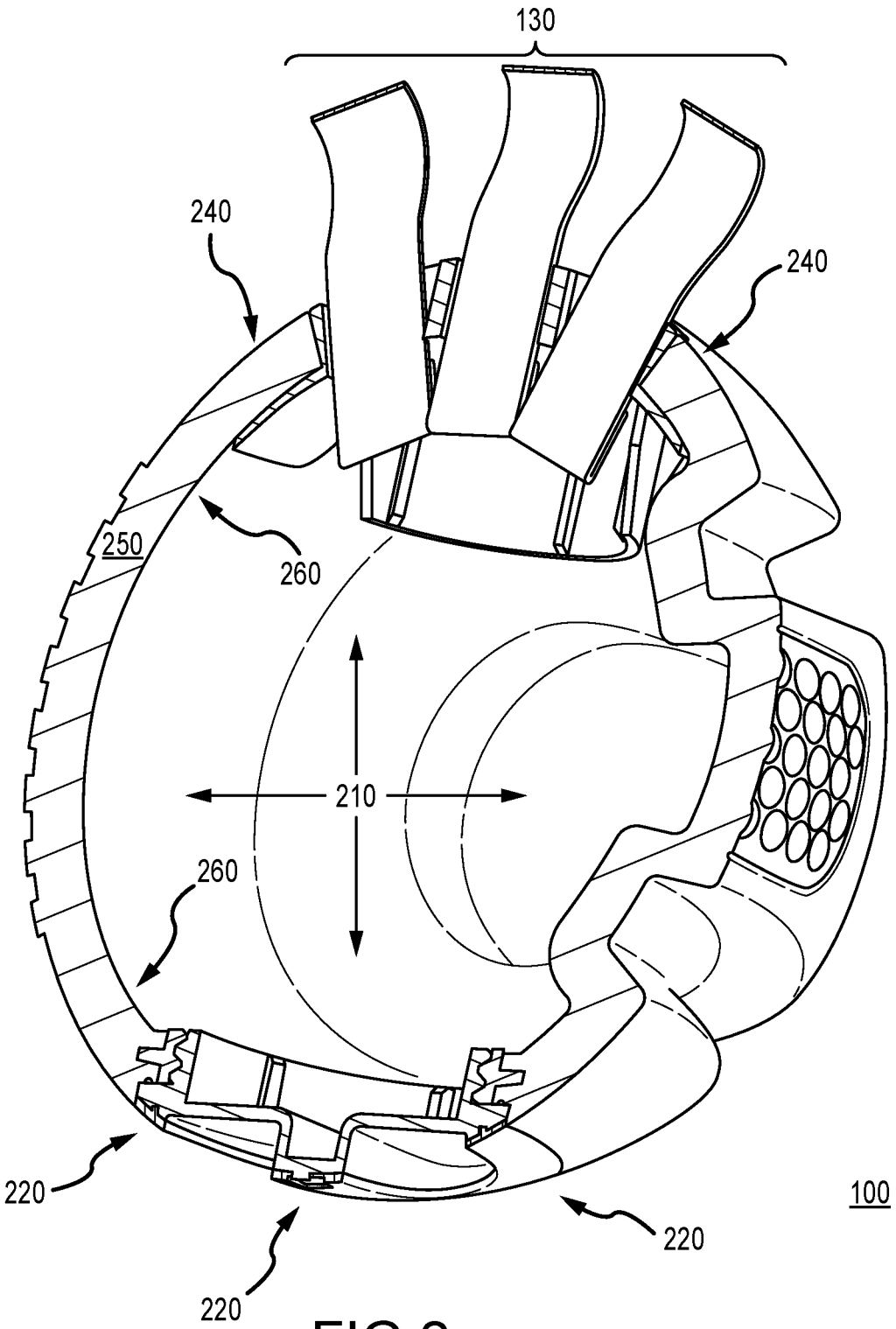
FIG. 2 is a cut-away perspective view of the one embodiment of the spherical dynamic resistance device.
Figure 3:
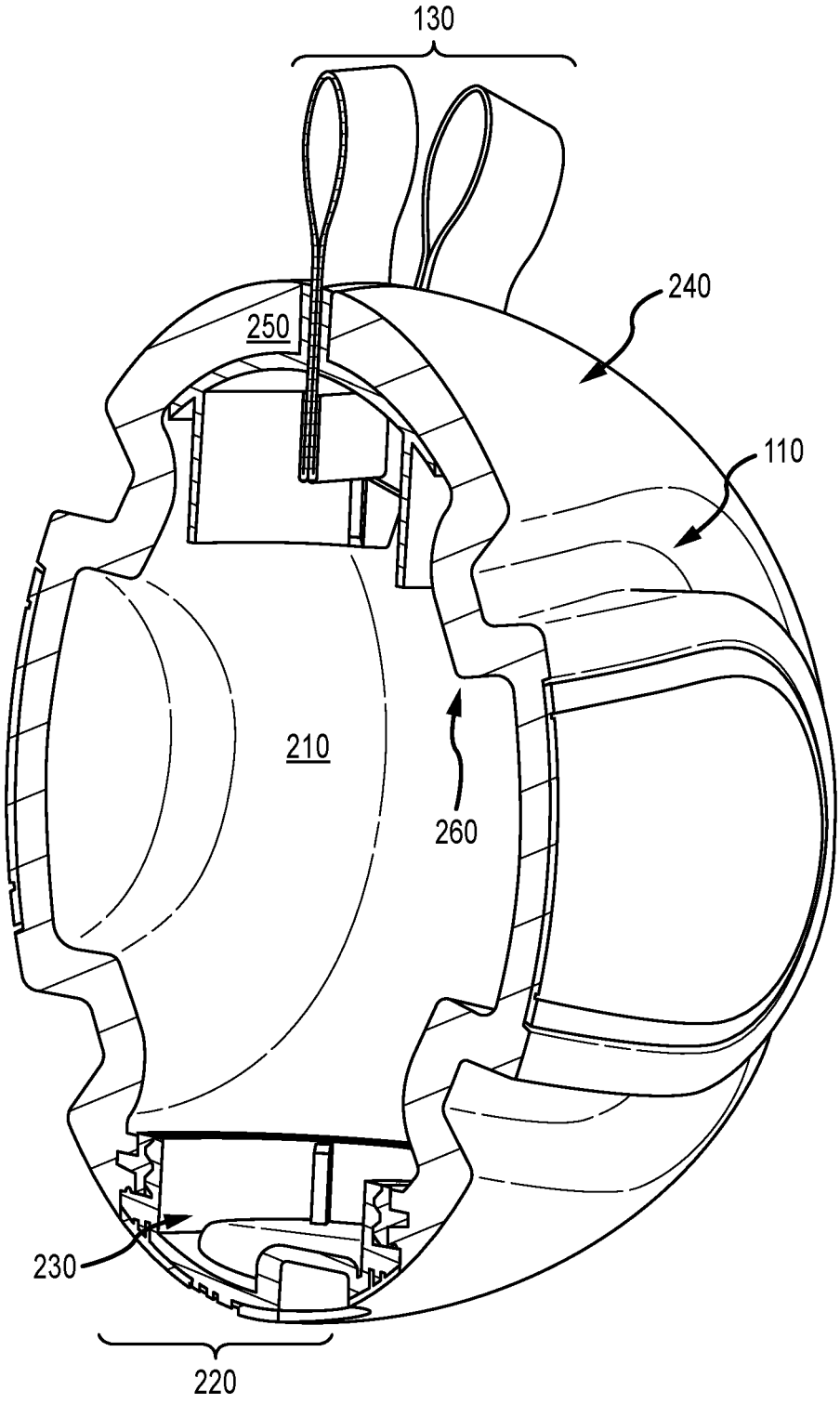
FIG. 3 is cut way perspective view the spherical dynamic resistance device of FIG. 2, rotated 90 degrees.

FIGS. 2 and 3 show a cut-away view of the spherical dynamic resistance device of the present invention from differing vantage points. FIG. 2 is a perspective cut-away view revealing an interior cavity 210 or void within the device. The cavity is accessed via a circular port 220 which is covered by a removable lid 230. FIGS. 2 and 3 also show that the attachment points 130 traverse the outer portion 240 of the casing 250, or shell, to the inner portion 260 and terminate in the cavity 210. Various mechanisms as would be known to one of reasonable skill in the relevant art secure the loops or attachment points to the device.

The device is comprised, in one embodiment, of a high-density foam. The high-density foam captures the spherical shape and provides the hollow core/cavity for storage of additional components while providing a tactile and pliable outer surface. Other materials such as rubber, fabric, leather and synthetics as would be known to one or reasonable skill are contemplated and within the scope of the present invention.

FIG. 3 is another cut-away rendering the spherical dynamic resistance device of the present invention. The internal cavity 210 is bound by an exterior casing 250 comprising an inner portion 260 and an outer portion 240. The outer portion 240 or outer surface, includes the serpentine channel 110 used to grip the device. The serpentine channel is a continuous loop that forms a "U" shape on opposite sides of the spherical device. The channels 110 are spaced apart to allow an average person to grip the device with the flat or palm portion of their hands and with their fingertips displaced into the channel 110. The channel 110 does not form a handle per se but facilitate irradiation of the muscles in the hands, arms and core.

Figure 4A:
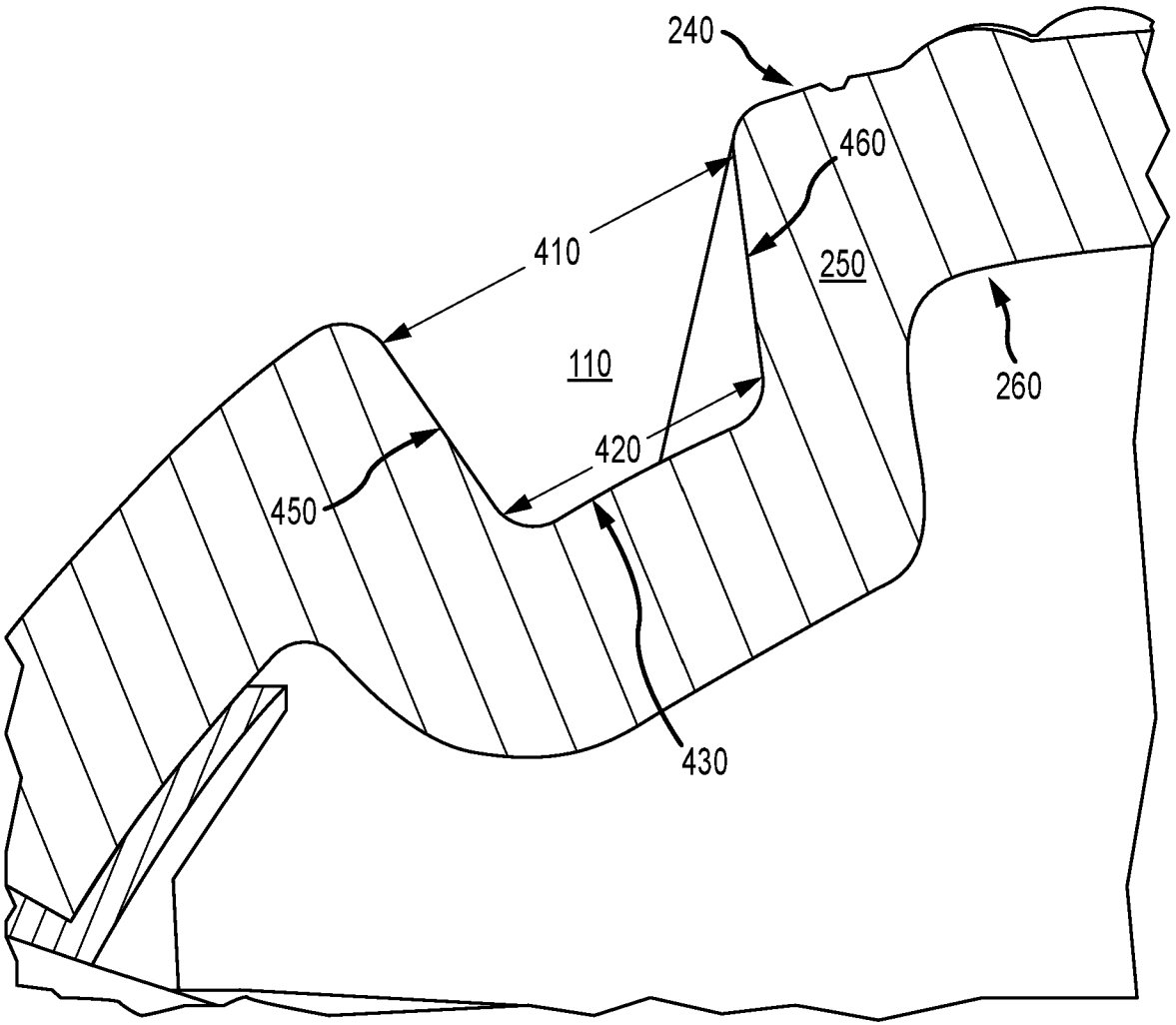
FIGS. 4A-4C are expanded cut-away views of the serpentine channel of the outer surface of the spherical dynamic resistance, according to one embodiment.
Figure 4B:
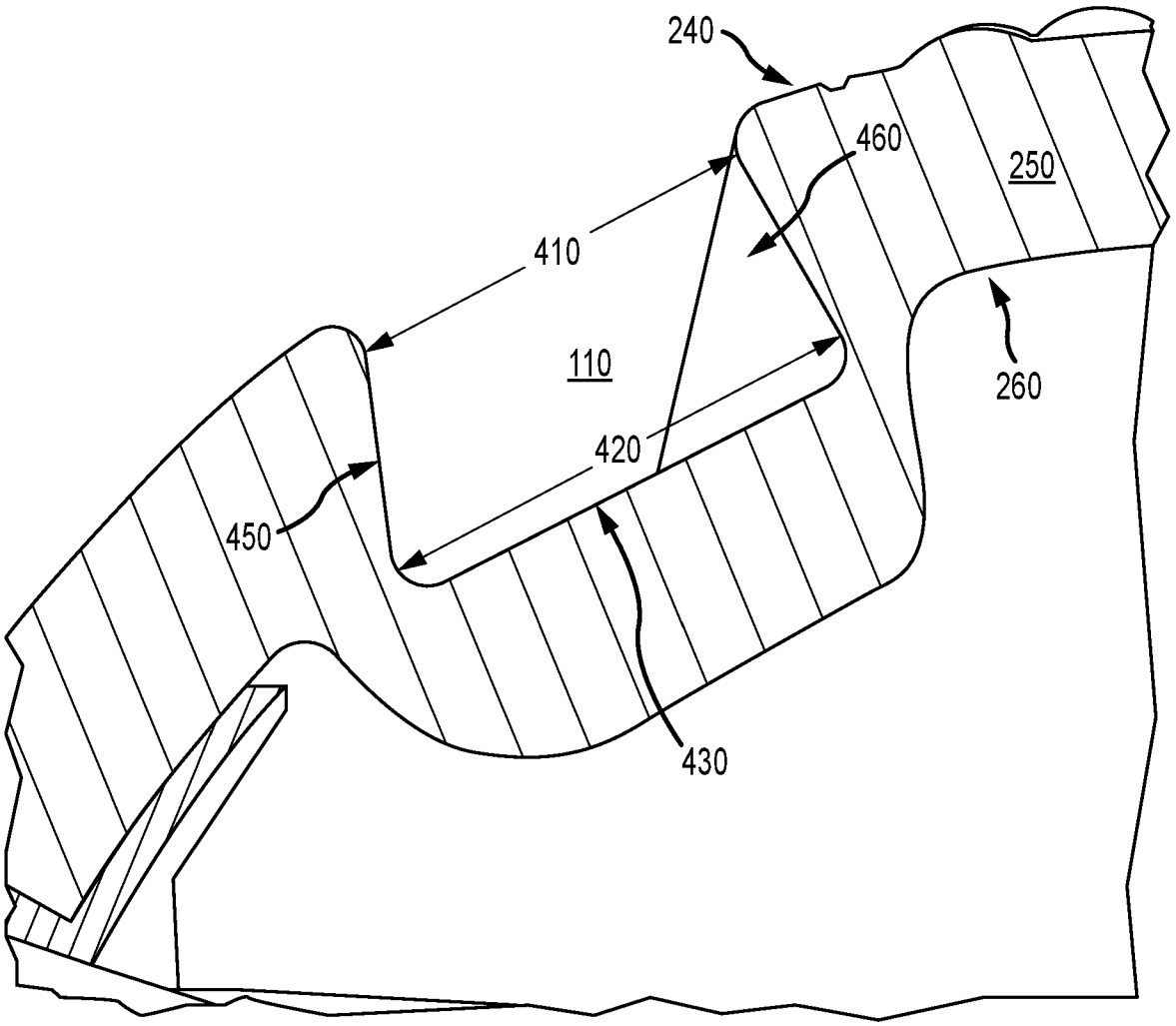

Additional reference to FIGS. 4 A, B and C provide a side or end view of the serpentine channel associated with the outer portion of the invention. The channel 110 is displaced inward from the outer surface 240 of the casing 250 or shell of the spherical dynamic resistance device of the present invention toward the inner portion. The channel 110 itself includes a first width 410 associated with the outer surface 240 and a second width 420 associated with a bottom channel surface 430. In one embodiment of the present invention the first width 410 is larger than the second width 420.

Figure 4C:
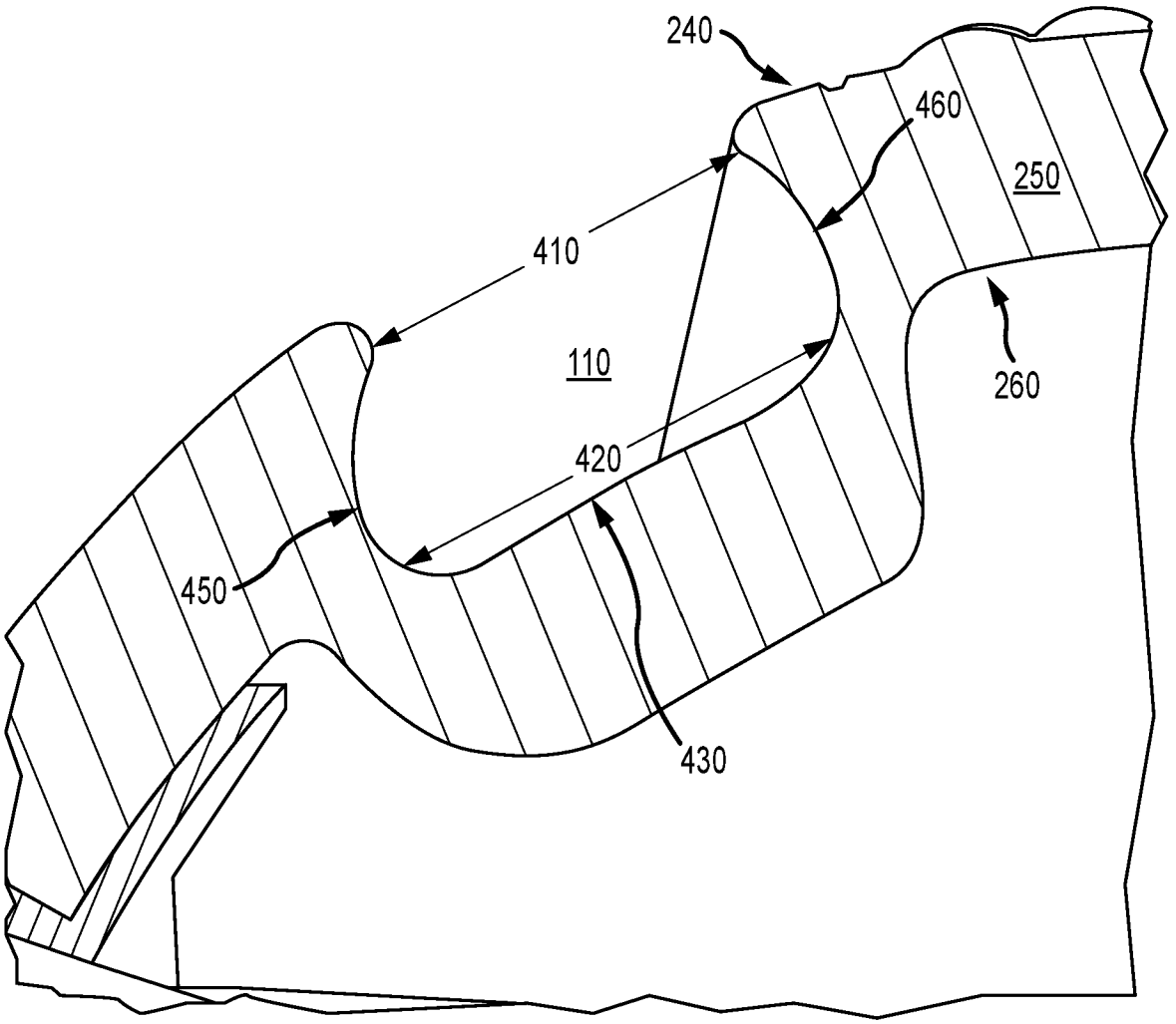
Figure 5:
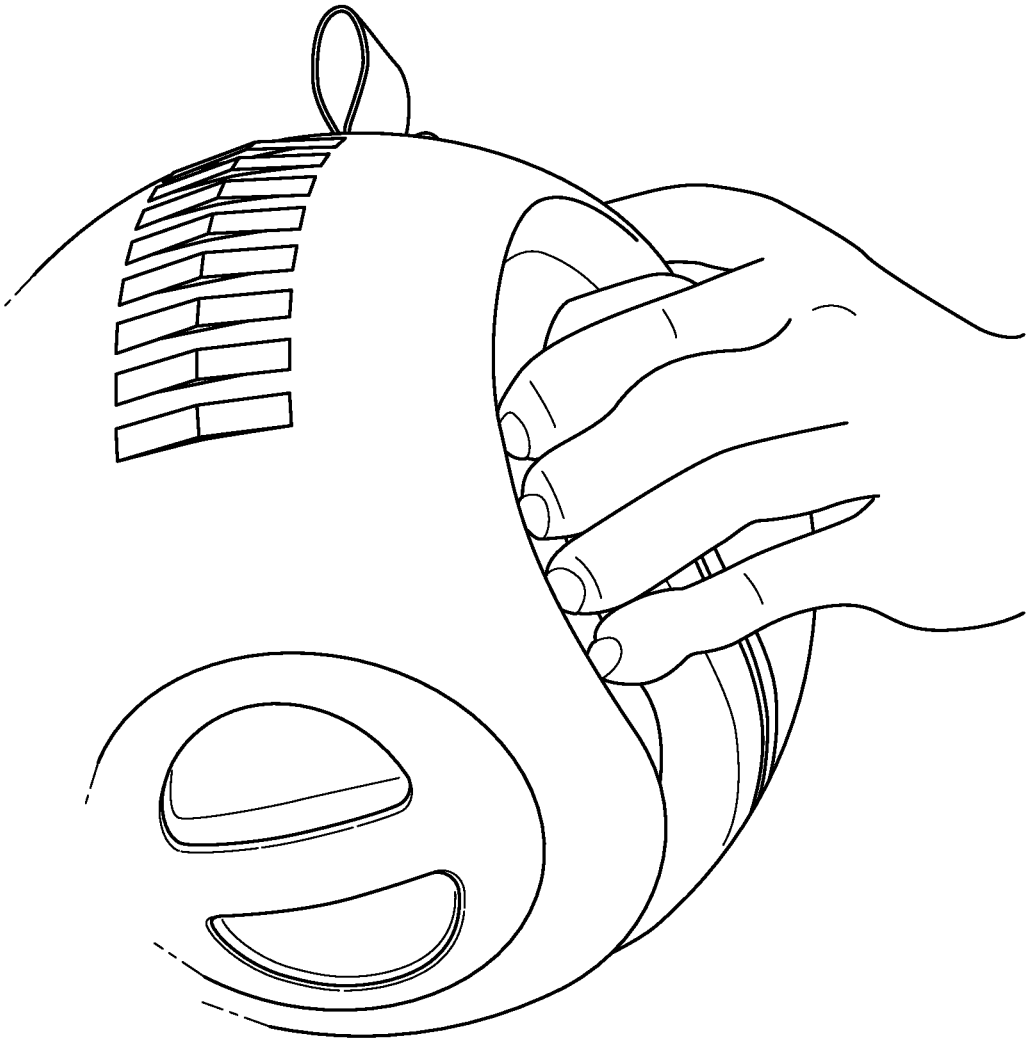
FIG. 5 depicts handholds of the serpentine channel of the outer surface of the spherical dynamic resistance, according to one embodiment.

The channel 110 also includes a first side wall 450 and a second side wall 460 wherein each side wall spans between and terminates at the outer surface 240 and the bottom surface channel 420. In one embodiment of the present invention as shown in FIG. 4C, each side wall possesses a concave shape making the channel adopt a convex profile. By having the walls 450, 460 curve outward (concave) expanding the central portion of the channel 110, a user is able to grip and hook the channel with their fingers as shown in FIG. 5. Adding the pliable or deformable nature of the outer portion of the spherical dynamic resistance devices creates an engageable surface by which a user can grip the device, activate their muscles and gain an efficient and effective workout.

Figure 6:
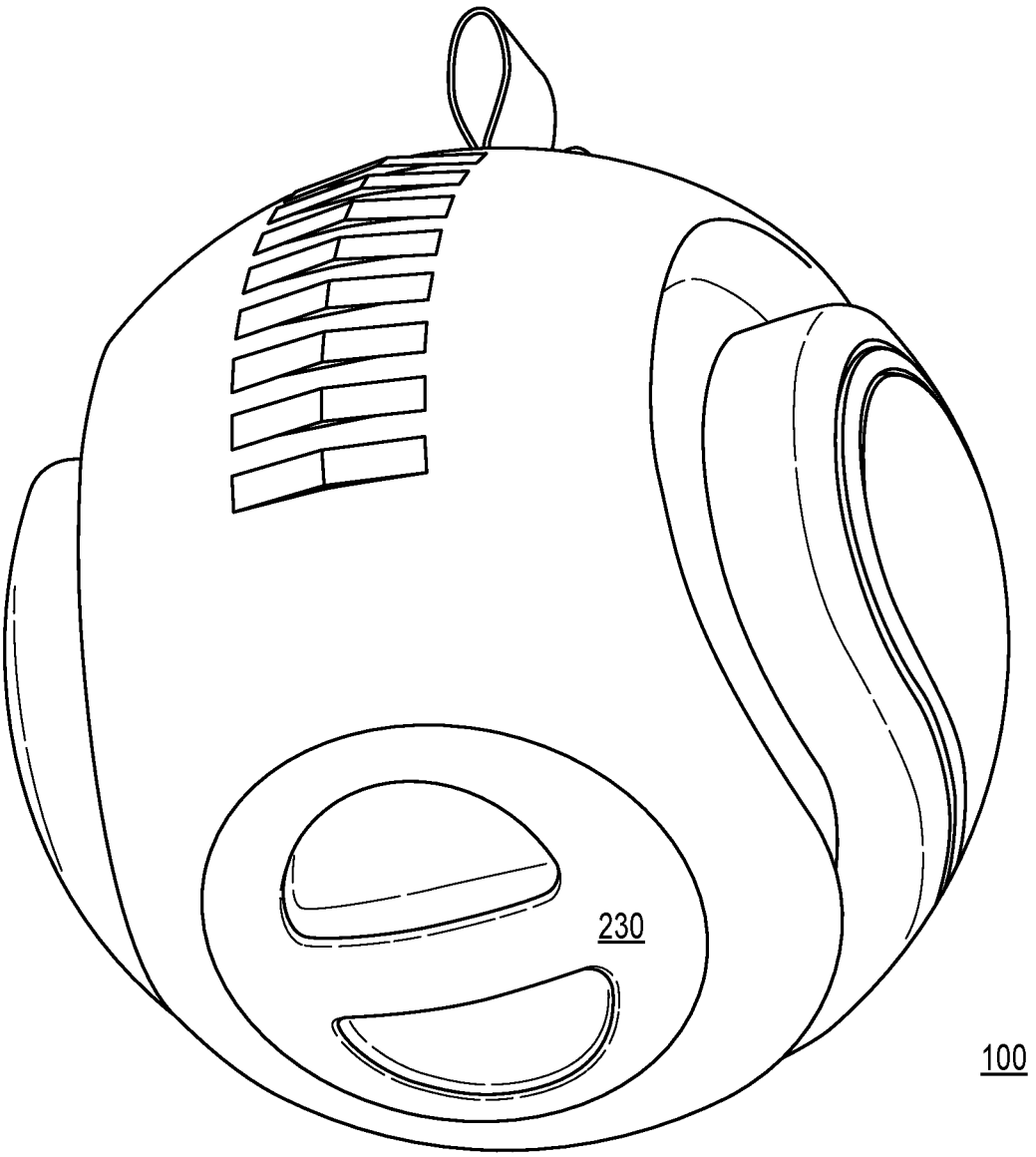
FIG. 6 is a perspective view of one embodiment of the spherical dynamic resistance device illustrating the circular covering to the internal cavity.

As previously described, the cavity or void portion of the device is accessed via a port located opposite the attachment points as shown in FIG. 6. In one embodiment the port 220 is circular and configured to accept a removable covering or lid 230. In one embodiment the covering latches or screws into a corresponding receiving portion housed in the outer portion of the casing, thereby joining the spherical shape of the device.

Figure 7:
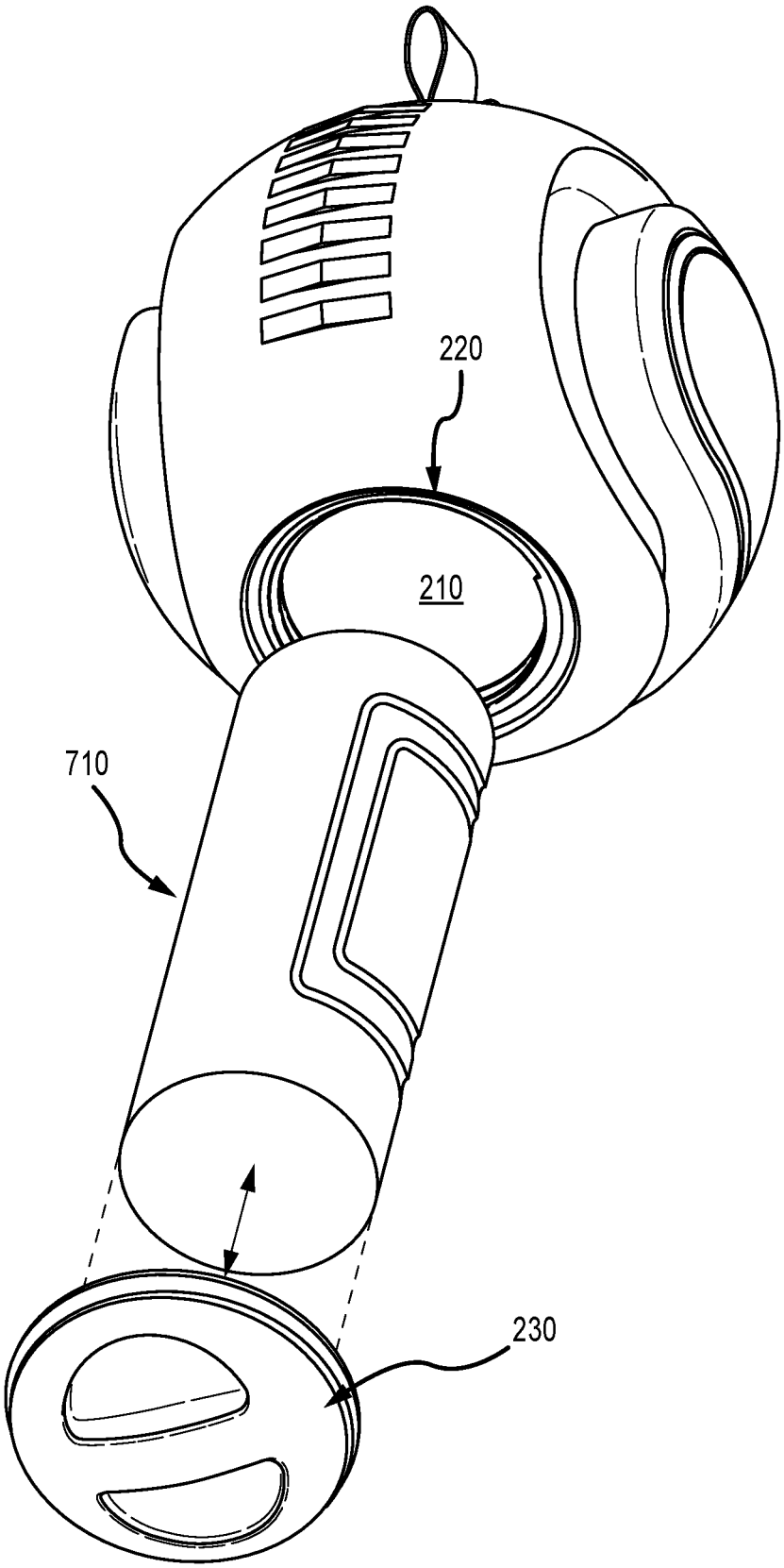
FIG. 7 shows a mass core insert in the void interior region of the spherical dynamic resistance, according to one embodiment of the present invention.
Figure 8B:
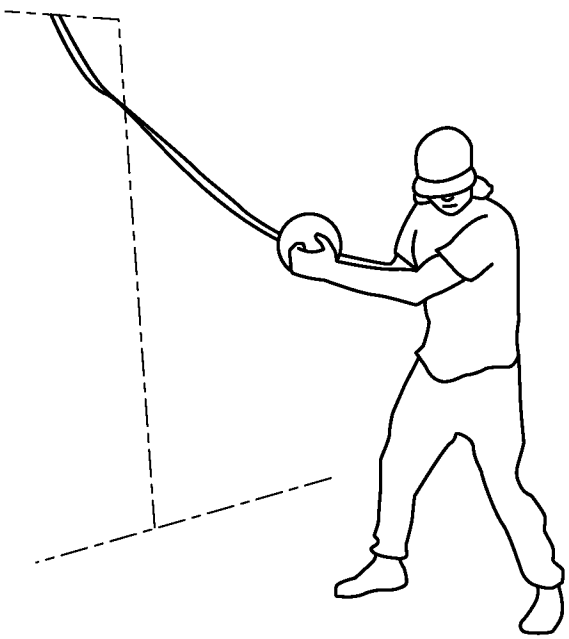
FIGS. 8A-8F are high-level depictions of use of the spherical dynamic resistance device of the present invention.
Figure 8A:
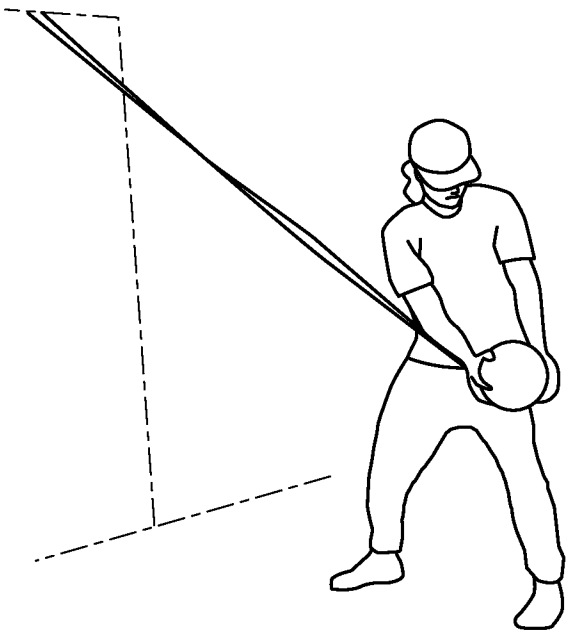
Figure 8D:
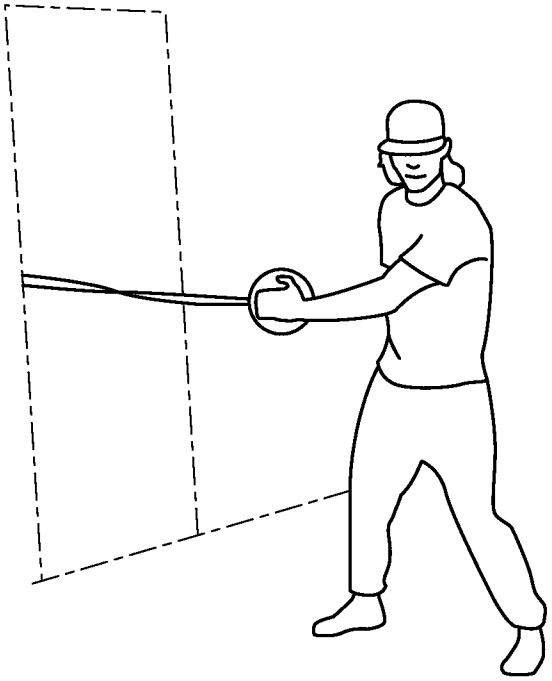
Figure 8C:
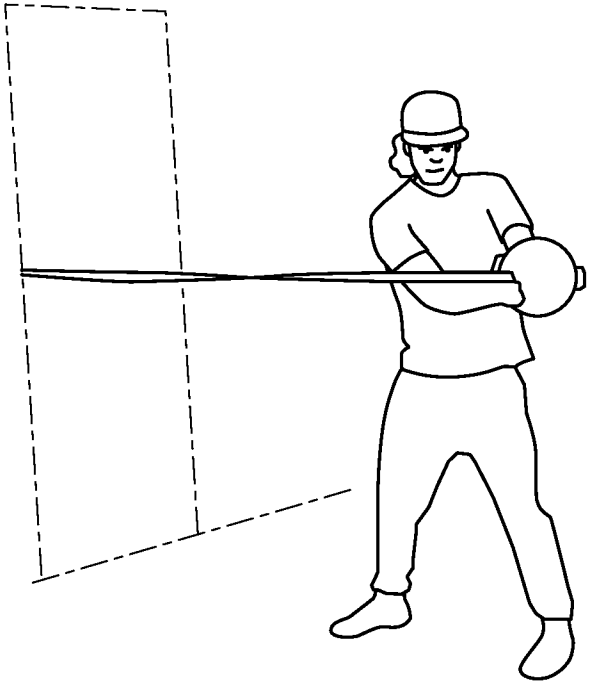
Figure 8F:
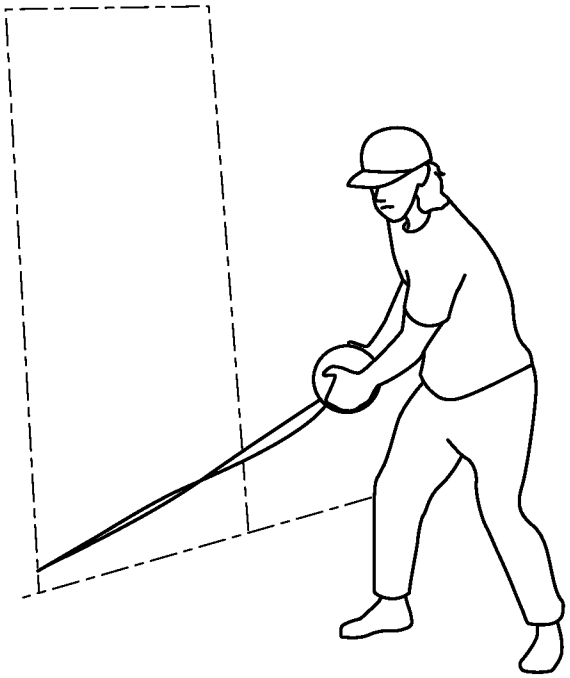
Figure 8E:
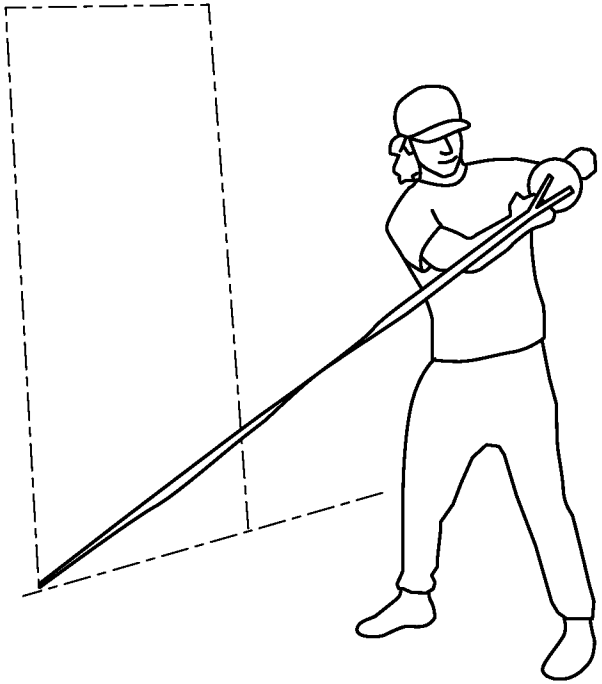

In another embodiment of the present invention the interior portion of the covering or lid accepts a weighted element or mass core as shown in FIG. 7. The weighted element 710 is, in one embodiment, cylindrical and affixes to the interior portion of the lid 230. The lid 230 and mass core addition 760 are thereafter inserted into the cavity 210 thereby adding mass to the spherical dynamic resistance device 100 of the present invention. A variety of mass core accessories can attach to the lid and thereafter inserted into the device. By having a mass core assessor of 1, 2, 4, 8, 10, etc. lbs., the total weight of the spherical dynamic resistance device 100 can be customized. In other embodiments the mass core or similar weighted accessor can simply be inserted into the cavity without being attached or affixed to the lid. Indeed, the unstable of a mass within the cavity adds additional fitness advantages. For example, a 2 lbs. bag of sand (or the like) inserted and sealed inside the device will create a substantial dynamic impulse force as it shifts within the device during exercise movements.

Incorporated into the outer surface of the device are a variety of roller bumps, similar to a foam roller, to aid in grip, muscle relief and flexibility.

The present invention allows a user to grip the ball (device) in a way that activates muscles. The device is portable and allows the user to store resistance bands inside when not in use. It further incorporates a modular weighted core that can be inserted into the device to make a workout harder—there are multiple weight levels so the device can "adapt/scale" as you grow stronger. Lastly, the device is ideal for home use as no other device offers multiple connection loops for the resistance band to connect to and can easily be affixed to an internal structure to form the centroid of a resistance workout.

FIGS. 8A-8F provide an illustration of how the spherical dynamic resistance device of the present invention can be used in an exercise routine. The present invention combines in a single device grip strength training, resistance of motion from the resistance bands and a weighted core. The combined and synergistic features of the present invention activate and challenge multiple muscle groups simultaneously, substantially increasing the effectiveness and efficiency of any workout.

In one embodiment a resistance band, stored internally in the cavity of the device, is removed and attached the device at one of the attachment points. A carabiner or similar attachment apparatus can be used as would be known to one of reasonable skill in this field of endeavor. After removal of the resistance band the lid/cover is replaced and the other end of the resistance band is attached to a fixed item, wall, door frame or the like. In one embodiment a door anchor attachment either incorporated into the resistance band or coupled to the band as a separate component secures the resistance band to a door/door frame when the door is closed. Such an anchor enables the device to be used virtually anywhere.

In FIGS. 8A-8F the resistance band is shown fixed behind a door such as might be found at a residence or a hotel room. In this case the band is anchored at the upper portion of the door above the individual. The user can step away from the door until the band becomes engaged and grasp the device with both hands. While holding the device, the hand, arm and core muscles are engaged simply to resist the force exerted on the device by the resistance band. As the user twists the force exerted by the band and the weight of the ball interact require full engagement by the user's hand, arm, shoulder, core and leg muscles. Using repetitive motions, stepping forward or backward and a variety of other positions results in a full body workout. And, by relocating the anchor point of the resistance band, such as at a lower portion of the door, an entire new set of exercise can be conducted.

The spherical dynamic resistance device of the present invention is a versatile exercise tool that is compact, portable, and suitable for a wide range of exercises, locations of use, and users. Whether the user is an athlete or simply enjoys home fitness routines, the invention offers the ability to engage multiple muscle groups resulting in both cardiovascular and anerobic exercises.

Upon reading this disclosure, those of skill in the art will appreciate still additional alternative structural and functional designs for the spherical dynamic resistance device through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

What is claimed is:

1. A fitness device, comprising:

a spherical casing having an inner portion and an outer portion wherein the outer portion includes an outer surface having a serpentine continuous channel extending toward the inner portion from the outer surface, the serpentine continuous channel having a depth, a first width associated with the outer surface and a second width associated with a bottom channel surface wherein the second width is less than the first width;

a void region encompassed by an inner surface of the spherical casing;

a circular access port configured associated with the spherical casing configured to access the void region from the outer portion;

a circular plug removably attached to the outer portion and configured to cover the circular access port;

one or more attachment loops secured to the outer portion; and one or more resistance bands removably coupled to one of the one or more attachment loops.

2. The fitness device of claim 1, wherein the one or more resistance bands includes a door anchor.

3. The fitness device of claim 1, wherein the one or more resistant bands are storable within the void region.

4. The fitness device of claim 1, further comprising a mass element insertable into the void region through the circular access port and attachable to the spherical casing.

5. The fitness device of claim 1, wherein the serpentine continuous channel includes opposing walls extending from the outer surface to the bottom channel surface and wherein each of the opposing wall has a concave shape.

6. The fitness device of claim 1, wherein the serpentine continuous channel forms a "U" shape on opposite hemispheres of the outer portion.

7. The fitness device of claim 1, wherein the serpentine continuous channel is substantially parallel on a single hemisphere of the outer portion.

8. The fitness device of claim 1, wherein the serpentine continuous channel includes a convex shape configured to engage contralateral irradiation muscle activity of a user.

9. A fitness device comprising:

a spherical shell having an outer surface wherein the outer surface includes a serpentine continuous channel extending toward an inner portion of the spherical shell from the outer surface, the serpentine continuous channel having a depth, a first width associated with the outer surface and a second width associated with a bottom channel surface wherein the second width is less than the first width;

a cavity extending inward from an inner surface of the spherical shell;

an access port configured to provide access to the cavity;

a covering attachable to the outer surface of the spherical shell and configured to cover the access port;

a plurality of mass elements wherein each of the plurality of mass elements is singularly insertable within the cavity and secured to the access port; and one or more attachment points secured to the outer surface of the spherical shell.

10. The fitness device of claim 9 wherein the attachment points are loops.

11. The fitness device of claim 9, further comprising one or more resistance bands removably coupled to the one or more attachment points.

12. The fitness device of claim 11, wherein the one or more resistance bands includes an anchor configured to secure the one or more resistance bands to an immovable structure.

13. The fitness device of claim 11, wherein the one or more resistant bands are storable within the cavity.

14. The fitness device of claim 9, wherein the serpentine continuous channel includes opposing walls extending from the outer surface to the bottom channel surface and wherein the opposing walls have a concave shape.

15. The fitness device of claim 9, wherein the serpentine continuous channel forms a "U" shape on opposite hemispheres of the outer surface.

16. The fitness device of claim 9, wherein the serpentine continuous channel is substantially parallel on a single hemisphere of the outer surface.

17. The fitness device of claim 9, wherein the serpentine continuous channel is configured to engage contralateral irradiation muscle activity of a user.

18. The fitness device of claim 9, wherein the spherical shell is pliable.

19. The fitness device of claim 9, wherein the spherical shell is injection molded foam.

* * * * *